United States Patent [19]

Sparks et al.

[11] Patent Number: 4,542,836

[45] Date of Patent: Sep. 24, 1985

[54] LIQUID DISPENSING SYSTEM

[75] Inventors: David J. Sparks, Chippenham; Keith Whitefoot, Swindon; John S. Knubley, Penzance, all of England

[73] Assignee: Castrol Limited, Swindon, England

[21] Appl. No.: 508,350

[22] Filed: Jun. 27, 1983

[30] Foreign Application Priority Data

Jul. 1, 1982 [GB] United Kingdom ..... 8219075

[51] Int. Cl.[4] ..... B67D 5/06

[52] U.S. Cl. ..... 222/27; 222/32; 377/21

[58] Field of Search ..... 222/23, 27, 28, 25, 222/30, 32, 35, 52, 60, 26, 129, 144.5, 136, 36; 377/21, 47; 364/464, 465, 479

[56] References Cited

U.S. PATENT DOCUMENTS

| | | | |
|---|---|---|---|
| 4,067,486 | 1/1978 | Hyde et al. | 377/21 |
| 4,071,742 | 1/1978 | Fleischer | 222/28 |
| 4,074,356 | 2/1978 | Schiller et al. | 222/23 |
| 4,290,538 | 9/1981 | White et al. | 222/32 |

FOREIGN PATENT DOCUMENTS

| | | |
|---|---|---|
| 1424957 | 4/1969 | Fed. Rep. of Germany . |
| 542147 | 11/1973 | Switzerland . |
| 1018566 | 1/1966 | United Kingdom . |

*Primary Examiner*—Joseph J. Rolla
*Assistant Examiner*—Kenneth Noland
*Attorney, Agent, or Firm*—Bacon & Thomas

[57] ABSTRACT

A liquid dispensing system comprises a supply of liquid (121), a pump (101), a meter (161) and a plurality of dispensing points or stations, (181) each controlled by a solenoid valve (201). A control box (281) monitors the meter and controls by electronic apparatus which station is enabled (that is, which solenoid valve (201) is opened) and displays on a display (261) provided a reading derived from the meter. In one embodiment, selection of a station (181) is effected at the control box but the invention also provides electronic apparatus enabling selection to be effected at each station. The invention does away with the need for a meter at each station and finds application in the dispensing of oil or the like in garage workshops.

30 Claims, 6 Drawing Figures

LIQUID DISPENSING SYSTEM

TECHNICAL FIELD

This invention relates to a liquid dispensing system for dispensing measured quantities of a liquid at a number of discrete locations from a single source. More particularly the invention relates to a system for use in garage workshops and similar areas to dispense metered quantities of oil or the like.

In many garage workshops it is impractical and over-expensive to dispense oil and other lubricants and fluids from fixed quantity containers. Nevertheless garage proprietors require to know how much fluid is given to a particular customer's car so that he can charge the customer appropriately and of course to ensure that the vehicle is supplied with the correct amount of that fluid.

BACKGROUND ART

Thus presently available systems dispense oil from a central tank by way of a pump and a number of meters disposed at each dispensing station or location. Unfortunately meters and associated joints are susceptible to leaks and a plurality of meters even more so. The meter at a dispensing station is set to zero by the user before oil is drawn off and the quantity dispensed noted by the user. Unfortunately there is no check available on the quantity of oil delivered and so the system is open to abuse. That is, not all the oil dispensed finds its way to customer's cars. While oil remained relatively cheap, pilfering was on a fairly small scale and losses to the garage proprietor were insignificant. Now, however, the situation has changed somewhat.

The meters in present use in retail outlets must have in the United Kingdom Board of Trade approval to protect customers and to ensure accuracy. Satisfactory meters are relatively large and heavy and come essentially in two kinds. Firstly, there are the wall-mounted meters which are the larger of the two kinds. These must be mounted on a secure structure and supplied with oil lines from the pump and to the delivery hose. It has a large meter dial which can be set to zero and which can be seen from some distance off.

Secondly there are the hose-end meters. Although much smaller they are still quite bulky and require a certain amount of manipulation in order to render them in a position where the dial can be reset and read. Nevertheless they are at the point of application of oil and so are often preferred to wall mounted meters. However, the meters disposed at the end of the hose tend to suffer from maltreatment and so the problem of leaks increases. Moreover, because of the weight and bulk of even these smaller meters it is necessary to employ reeled, thick-walled, spirally-wound double wire insert rubber hose which increases the overall bulkiness of the arrangement.

In any event, although the meters are accurate, their analogue dials often provide an inaccurate read-out so that there may occur an error in any but the largest quantities dispensed in the order of about 5%. Thus it is often not permitted to dispense less than a preset minimum quantity of oil in order to keep the error as small as possible.

Furthermore, although the systems used hitherto are satisfactory in most respects, except as mentioned above, the provision of a meter at each dispensing station is space consuming and more importantly, expensive.

It is an object of this invention to provide a liquid dispensing system of the type referred to which alleviates at least some of the problems referred to above.

SUMMARY OF THE INVENTION

In accordance with this invention there is provided a liquid dispensing system comprising a control station, a plurality of dispensing stations, a pump means and a meter to measure the quantity of liquid pumped by the pump means to the dispensing stations, each dispensing station comprising a dispensing point for the liquid and a display and the control station comprising electronic means to select and enable any one dispensing station whereby liquid is dispensible at that station, to disable the other dispensing station or stations whereby liquid is not dispensible at said other station or stations, to monitor the meter and to effect a reading on the display at said one dispensing station, said reading corresponding to the volume of liquid passing through the meter and being dispensed at said one dispensing station.

Preferably said electronic control means includes means to disable and cancel any existing selection of a station when another station is selected.

Alternatively said electronic control means includes means enabling a number of stations to be selected but one only to be enabled when a previously enabled station is unselected.

The main advantage of the system according to the present invention is that only a single meter is employed for dispensing to a number of separate dispensing stations such that the risk of leaks is reduced and more importantly the capital cost of the system is considerably reduced.

Moreover, having removed the bulky meters from the scene of dispensing, more convenient hoses can be employed. For instance helically coiled hoses of the type familiarly used for air lines in heavy vehicles may be used. These hoses are neater, less bulky and do not require coiling and storage apparatus. Also, because they can twist quite easily there is no requirement for swivel joints at the dispensing nozzle which has hitherto particularly been the case where hose-end meters were employed. Removing swivel joints of course reduces still further the risk of leaks.

Also the display is an entirely separate entity from the liquid supply line and so, unlike wall-mounted meters, the display may be mounted at any convenient point. For instance most dispensing of oil to cars in garage workshops takes place while the car is on a hydraulic lift, often of the two or four post variety. Thus a very convenient location for mounting of the display is often on one of the lift posts.

BRIEF DESCRIPTION OF THE DRAWINGS

The invention is further described hereinafter with reference to the accompanying drawings, in which.

DETAILED DESCRIPTION OF THE INVENTION

Figure 1:
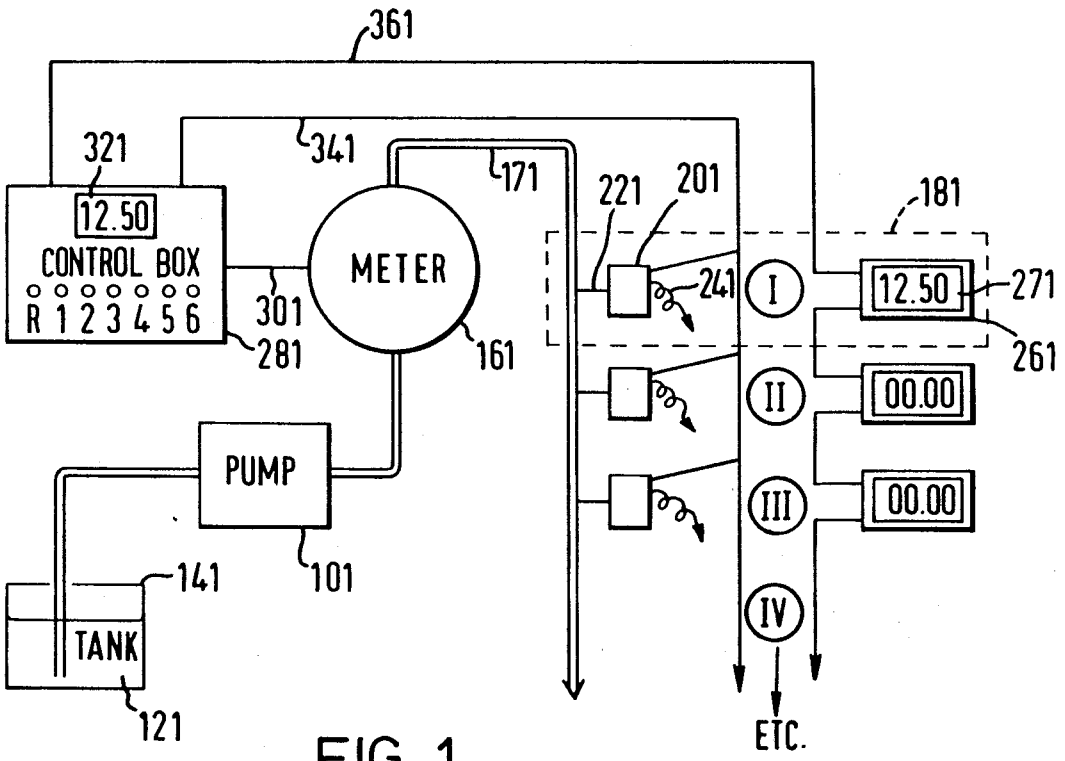
FIG. 1 is a schematic illustration of a liquid dispensing system in accordance with the invention.

An oil dispensing system according to the invention is schematically illustrated in FIG. 1 and comprises a supply 121 of oil in tank 141, a pump 101, a meter 161 and dispensing stations 181 disposed around a work area.

Each dispensing station requires oil and needs to know how much is being delivered. Thus it is imperative that only one station 181 is allowed to withdraw oil at a time and that a reading indicating how much oil has been taken is available to that station.

Thus electronic control means in a control box 281 monitors along line 301 the state of the meter 161 which is arranged to establish pulses in line 301 as precise known volumes of oil pass through it. That is to say each pulse represents a specified volume of fluid.

Thus the volume of oil passing through the meter 161 can be recorded and displayed on display 321 on the control box 281. The control box, under manual supervision, also controls which station receives the oil. Any one of six stations may be selected (although the system can accommodate up to 15 stations as is explained below) and this has the effect of resetting the display 321 to zero and via line 341 opening a solenoid valve 201 disposed in a branch 221 of supply line 171 to the station selected. Other solenoid valves disposed in similar branches to other stations remain closed such that only the station selected can withdraw oil. Withdrawal of oil is effected once a station has been selected by opening a tap (not shown) at the end of coiled hose 241. The control box also arranges, by means explained below, to display on a display 271 the reading showing on display 321. This reading is displayed only at the station selected, all zeros being relayed to the other stations.

Box 261 containing display 271 can be mounted at any convenient point entirely independently of the branch 221, valve 201 or hose 241. Thus it does not require robust construction because it can be disposed out of harm's way. Moreover, the control box 281 does not require to be adjacent the meter 161 but can in fact be disposed wherever convenient. If security from pilfering is required it can be disposed in a workshop stores area where records of oil dispensed and at which station can be made.

Figure 2:
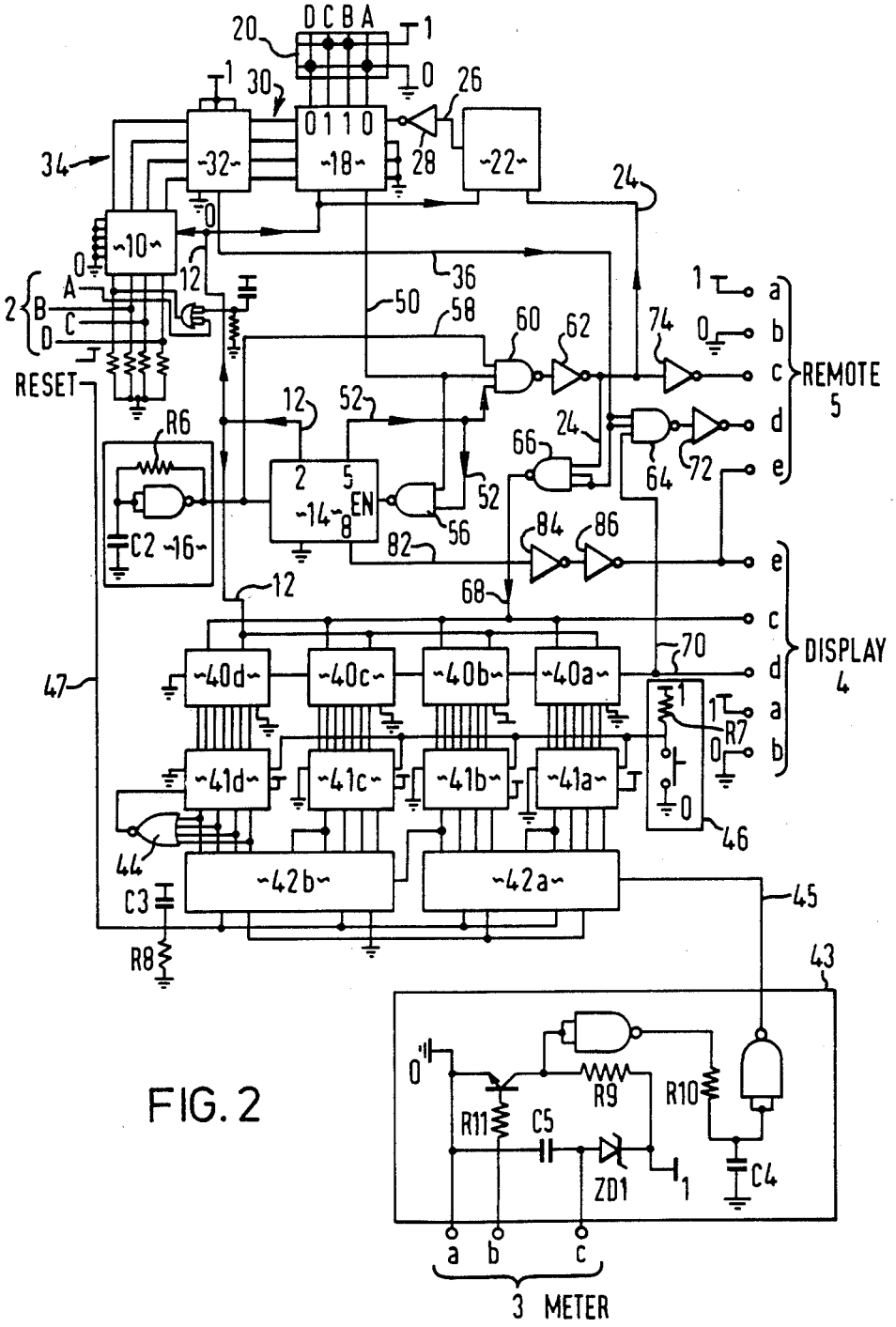
FIG. 2 is a logic circuit diagram suitable for putting the system illustrated in FIG. 1 into effect.

A convenient logic circuit for putting the invention into effect is illustrated in FIG. 2.

Selection of a station causes a four bit binary coded decimal (BCD) code unique to that station to be applied at 2 along lines ABCD. The BCD codes are in numerical order with the first station being coded 0001, the second 0010 etc. up to a maximum of 1111 for the fifteenth. This code is applied to a quad D-register 10 but is only loaded thereto when it receives an enabling signal along line 12 from decade counter divider 14.

Decade counter divider 14 receives a continuous stream of pulses from clock pulse generator 16 once the dispensing system is energised and the counter 14 immediately begins counting. On the count of 2, an enabling signal is applied to line 12 which, while loading register 10 also presets BCD programmable up/down counter 18 with a preselected four bit BCD-code from switch 20. The counter 18 is set to count down. The four bit BCD code from switch 20 represents the total number of dispensing stations in operation which, in the present instance, is six or 0110 in binary. The enabling signal in line 12 also resets to zero a 7-stage binary counter 22 which is arranged to receive clock pulses along line 24. The counter 22 is so arranged that every 32 pulses it receives along line 24 one pulse is applied to line 26 and thus, via NOT gate 28, to counter 18. Pulses applied to counter 18 count it down from the preselected value input by switch 20. The value remaining in the counter 18 at any time, is applied, via lines 30, to comparator 32 which also receives via lines 34 the BCD value stored in register 10 and representing the station selected.

When the BCD value in counter 18 is the same as is stored in register 10 comparator 32 provides an enabling signal along line 36.

Turning to line 3 from the meter, this receives pulses at terminal *3b* from the meter (not shown) when the system is energised, each pulse representing a specific quantity of liquid passing through the meter. After shaping by appropriate circuitry 43, the pulses are fed on line 45 to serially-connected dual BCD-decade up-counters 42*a*, 42*b*. These are reset to zero by energising RESET line 47 or by selecting a station.

The four four-bit BCD counts subsisting in counters 42*a* and *b* at any given time are applied to BCD-to-7-segment latch decoder drivers 41*a* to 41*d*. If 0000 is applied to driver 41*d* then this driver is disabled by NOR gate 44 to prevent a leading zero from being displayed. Furthermore, if the individual segments of the displays are to be checked flash ciruit 46 causes decimal 8's to be applied to the registers 40*a* to 40*d*.

Again, at any given time the 7-bit codes in the drivers 41*a* to 41*b* are applied to 8-stage parallel input/serial output shift registers 40*a* to 40*d*. The eighth input of each register 40*a* to 40*d* is free for use as a decimal point, only one of which is of course required, if at all. In this embodiment, register 40*b* has its eighth input connected to 1 indicating that the decimal point will appear before the numeral stored in register 40*b*. That is to say the total number stored is in the form: 12.34.

Although the 7-bit codes are applied to registers 40*a* to 40*d* it is only when the registers receive the enabling signal on line 12 on the count of 2 in counter 14 that the codes are in fact loaded into them.

Finally, the enabling signal on line 12 which occurs at the count of 2 in counter 14, as well as presetting counter 18, it also causes the counter 18 to provide an enabling signal on line 50 which is only subsequently removed when the count in counter 18 eventually reaches zero.

As the count progresses beyond 2 in counter 14, the enabling signal is removed from line 12. Thus the value in registers 40*a* to 40*d* are frozen, that is, isolated from any changes which may occur in drivers 41.

When the count reaches 5 in counter 14 an enabling signal is applied to line 52. Together with the enabling signal on line 50 this signal removes the enabling signal for the counter 14 which hitherto had been received from NAND gate 56. Thus counter 14 is frozen with an enabling signal on line 52.

Once again together with the enabling signal on line 50 the enabling signal on line 52 allows pulses from the clock pulse generator 16 on line 58 to pass through NAND gate 60 and NOT gate 62 to emanate on lines 24 where they are counted in counter 22. After every 32 counts in counter 22, the count in counter 18 is reduced by one. When after some multiple of 32 counts the count in counter 18 is reduced to a value which is the same as the value stored in register 10, then the comparator 32 establishes an enabling signal on line 36. It does this for only 32 counts in counter 22 because beyond this the count in counter 18 is reduced still further and hence is no longer the same as that stored in register 10. Thus for 32 pulses in line 24 an enabling signal in line 36 enables gates 64 and 66 respectively. Thus thirty-two clock pulses in line 24 can pass through gate 66. These are applied via line 68 to shift registers 40*a* to 40*d* such that the information contained in them (32 bits) is shifted completely from those registers into line 70. These thirty-two clock pulses are also applied to terminal c of a DISPLAY line 4. The information in line 70 is fed to terminal d of the DISPLAY line 4 and also to terminal d of REMOTE line 5 via NAND gate 64 (enabled by comparator 32 via line 36) and NOT gate 72. Clock pulses in line 24 are fed via NOT gate 74 to terminal c of REMOTE line 5.

Figure 3:
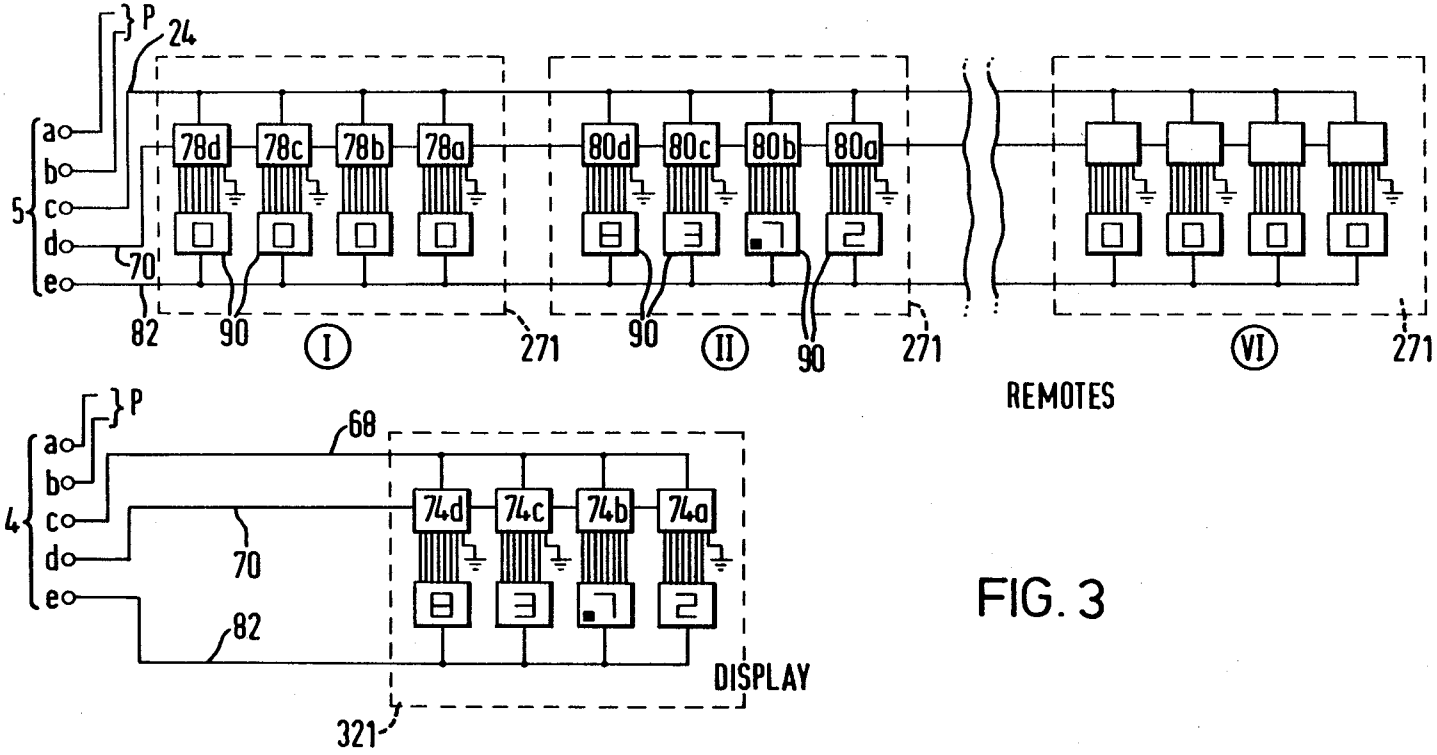
FIG. 3 shows the arrangements of the displays at three dispensing stations and in the control box.

Turning to FIG. 3, the information in registers 40*a* to 40*d* is progressively shifted therefrom into line 70, via terminal 4*d* and into four in line 8-stage serial input/parallel output shift registers 74*a* to 74*d* as the clock pulses in line 68 from terminal 4*c* activate them. The information previously held in these registers is lost. These registers 74 form a part of the display 321 on control box 281.

Also, the same information is progressively shifted via terminal 5*d* and line 70 into four 8-stage serial input/parallel output shift registers 78*a* to. 78*d* comprising the REMOTE display 271 of a first dispensing station I.

Returning to FIG. 2, when the enabling signal in line 36 ceases no more information can be extracted from registers 40*a* to 40*d* because the clock pulses on line 24 no longer reach line 68. Nevertheless the clock pulses still appear in line 24 and these are thus applied to terminal 5*c* and hence, after thirty-two pulses, the information now stored in shift registers 78*a* to 78*d* is shifted completely into registers 80*a* to 80*d* in the REMOTE display 271 of the second dispensing station II. While the clock pulses still persist in line 24 the information will progressively shift to subsequent displays.

When the information is shifted from registers 78 to registers 80 the new information stored in registers 78 is all zeros because no new data is supplied to terminal 5*d*. This occurs because the signal enabling gate 64 (i.e. on line 36) has ceased.

Thus every thirty-two pulses in line 24 the information moves from one dispensing station to the next. It continues to do this until on one multiple of 32 the count in counter 18 is reduced to zero. When this occurs the enabling signal in line 50 is removed. Thus gate 60 is disabled and no more clock pulses can pass to line 24. With NAND gate 56 also disabled the counter 14 is restarted.

On the eighth count that it registers from clock pulse generator 16, the counter 14 applies an enabling signal to line 82 which is transfered by gates 84,86 to terminals 4*e* and 5*e*. Turning to FIG. 3, the signal in line 82 enables all the 7-segment displays 90 to read what is in their respective registers 74,78,80 etc. and to display that information.

In one REMOTE display this information will be that which a few pulses before had been stored in registers 40 while the rest will be supplied with all zeros. Clearly the REMOTE display 271 which displays this information should be the display which is a part of the dispensing station which has been selected and this is effected by suitable choice of the BCD code applied to register 10 on selection of a station. The further that the information has to move away from its source in registers 40, then the sooner it must be allowed to enter the train; and the sooner it must enter the train then the larger the BCD-code must be in register 10 so that the count in counter 18 is reduced to that value sooner.

Thus suppose there are six dispensing stations and it is desired to dispense oil and record the information at the second station. Thus the second station is selected on the control box 281 which means the solenoid valve of this station is opened and oil can be withdrawn.

After the next count of two in counter 14 the register 10 will be loaded with the number 0010 (two) and the counter 18 with the preselected code 0110 (six stations). During the first set of 32 pulses, zeros will be entered in the first display and at the end of those pulses the counter 18 will be reduced to 0101 (five).

At the next set of 32 pulses a new set of zeros will be entered in the first display 271 and the first set of zeros will be transferred to the second display. Counter 18 will be reduced to 0100 (four). At the third set of 32 pulses there will be zeros in the first three displays and counter 18 will read 0011 (three). At the fourth set the first four displays will have zeros and counter 18 will be reduced to 0010 (two). At this time the count in counter 18 is the same as that in register 10 and so comparator 32 allows, over the next set of 32 pulses, the information in registers 40 to be shifted into the first display. Displays 2 to 5 will each have zeros. For the fifth set of 32 pulses the count in counter 18 will have been reduced to 0001 (one) and zeros will again be entered in the first display while the information in the first display is shifted into the second display. The zeros in displays 2 to 5 are also shifted to displays 3 to 6. At the end of those thirty-two pulses the count in counter 18 changes to 0000 (zero) and no more pulses will be allowed to shift the displays because counter 18 disables gate 60 when it is reduced to zero.

After three more pulses in counter 14, the displays are instructed to show what they have stored in their respective registers. The second display has the information previously held in registers 40. When the second station is first selected this information would of course be zeros as well but once oil is dispensed and the count in counters 42 change then the information displayed will also change giving an indication of the volume dispensed.

In one meter, one complete revolution of the main spindle means that one liter of fluid has passed through it. To obtain pulses from this, a disc having 100 slots arranged circumferentially around it is mounted on the spindle. A light source and light receptor are mounted on either side of the disc in such a way that light from the source can pass through a slot to impinge on the receptor. As the disc rotates the spokes separating the slots cut off the light to the receptor and this establishes a pulse which after amplification and shaping is fed to terminal 3*b* in the control box 281. Thus each pulse represents one hundredth of a liter so if the display shows: 12.34, then this means that 12.34 liters of oil have passed through the meter.

In an alternative embodiment, which is not illustrated schematically in the drawings, selection of a station is effected, not at the control box 281 but at each dispensing station. Thus it is quite feasible that more than one station may be selected at any one time although it must be ensured that only one station can be supplied with oil at any instant of time. Also, because selection is effected at a station it is not necessary to arrange a display at the control box. This embodiment therefore is used as a straight alternative to existing methods of oil delivery and where no extra security is required. The control box would be placed anywhere convenient, perhaps adjacent the meter.

When selection is effected at a station a light on the display box 261 indicates that the selection is made. Any number of stations may be selected. Only one station at a time is actually enabled however and the fact that a station is enabled is signalled to the operator by means of the display becoming activated. The displays at the other stations remain blank even if they have been selected. If other stations have been selected the control box "stacks" or "queues" those selections by means explained below until the station which was enabled is actually unselected. Then the next station in the queue is selected.

Figure 4:
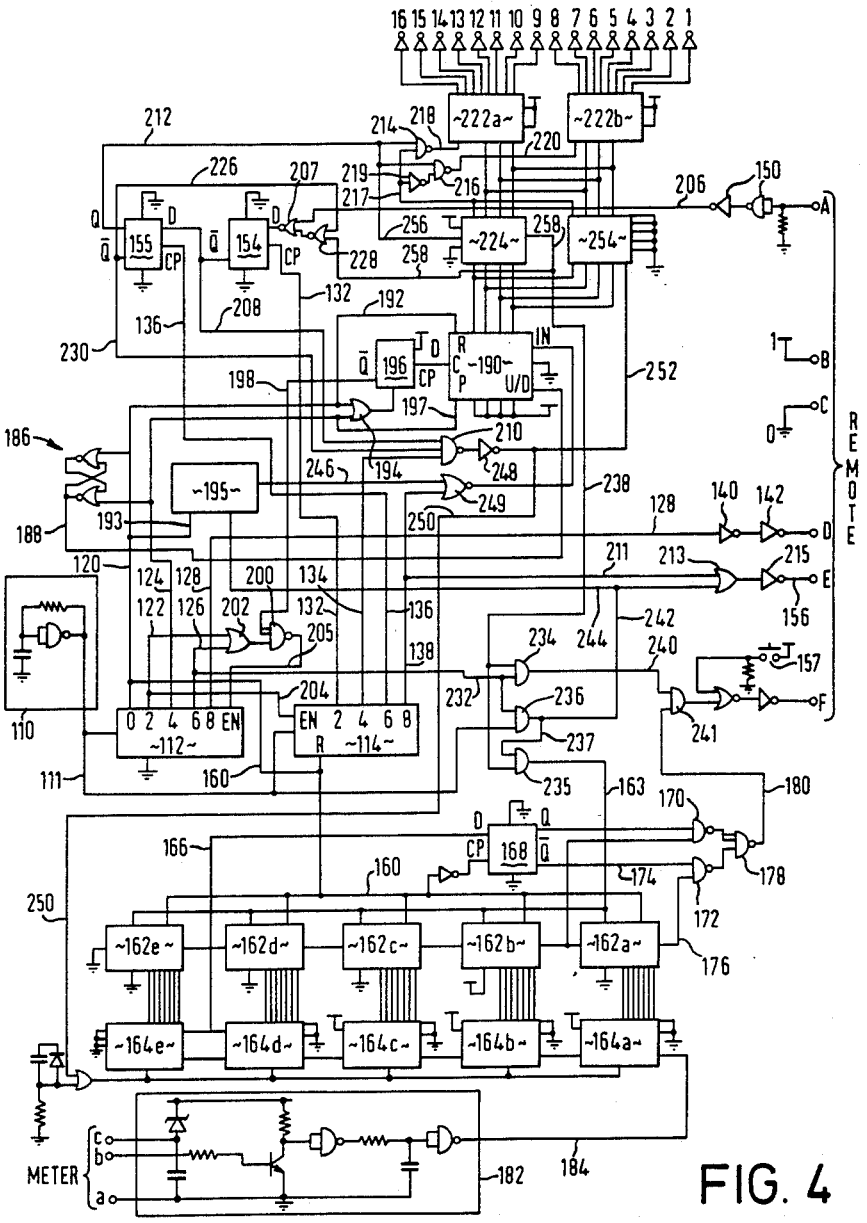
FIG. 4 is a logic circuit diagram suitable for putting a second embodiment of this invention into effect.

Inside control box 281 is contained the circuit elements illustrated in FIG. 4. Here a clock pulse generator 110 produces a continuous stream of pulses in line 111 which are fed to two decade counter dividers 112,114 which, while they are counting, produce enabling signals on specific lines after specified counts.

Thus counter 112 produces enabling signals on lines 120,122, 124,126 and 128 on counts 0,2,4,6 and 8 respectively while counter 114 produces enabling signals on lines 132,134,136 and 138 on counts 2,4,6 and 8 respectively.

Thus after a count of 8 in counter 112 an enabling signal is applied to line 128 which is connected, via gates 140,142, to terminal D of the REMOTE displays output.

Figure 5:
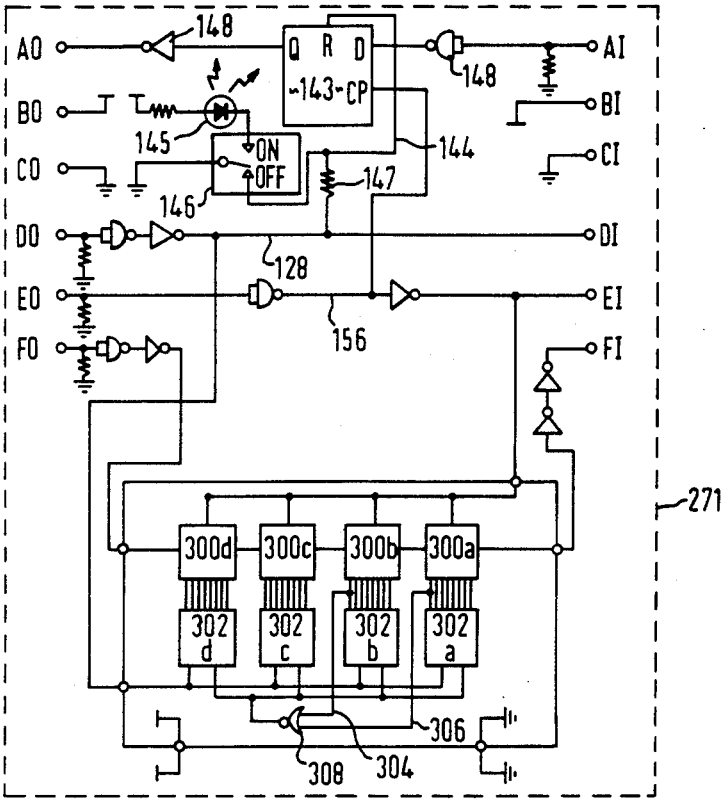
FIG. 5 is a logic circuit for a display suitable for use in said second embodiment; and, FIG. 6 is an enlargement of part of FIG. 4 showing the principle of station selection and enabling in said second embodiment.

Turning to FIG. 5 it will be noted that each display 271 comprises, in addition to the components present in the displays of the previous embodiments and illustrated in FIG. 3, a D flip-flop 143 whose reset line 144 is connected via two-way switch 146 to "zero". Moreover each display is connected to the next in-line or to the circuit of FIG. 4 from outputs AO to FO to corresponding inputs AI to FI or inputs A to F respectively.

The most remote display has its inputs AI to FI unconnected. Thus the D input to its D-flip-flop is always at "one". After several cycles after initial energisation of the circuit in FIGS. 4 and 5 and before any selection is made the D inputs and Q outputs are all at "one".

To select a particular station however the switch 146 of the appropriate display 271 is activated. This isolates line 144 from earth and makes effective its connection with line 128. When a "one" is applied to this line it will reset D flip-flop 143 such that when it next receives a clock pulse at its CP input on line 156, as explained further below, instead of a "one" appearing at its Q output a "zero" is applied which after two inversions is also applied to the D input of the next D-flip-flop 143 in the next display. As more clock pulses arrive on line 128 so the "selected state" of D flip-flop 143 passes down the line of displays 271 until, instead of a "zero" being the normally applied state of terminal A in FIG. 4, it changes to "one". If it changes to "one" after six clock pulses have been applied to line 156, terminal E then it is apparent that the sixth station "out" from the control box has been selected.

As it is also explained further below the count of 8 in counter 112 is the last count in the complete cycle of counts in both counters 112,114 and the complete cycle is thereafter repeated continuously. It is apparent that since station selection cannot be effected until the end of the cycle, the first cycle after energisation of the system will in effect be "selection free".

In the following description it is assumed by way of example that in a previous complete cycle the second station out is selected, although before considering this state in detail the situation where no selection is made is also considered.

Thus on the count of zero in counter 112 a "one" is applied to line 120. This firstly resets counter 114 via line 160 and loads 8-stage parallel input/serial output shift registers 162*a* to *e* with the count presently subsisting in decade counter-to-7-segment decoders 164*a* to *e*.

If the count in counters 164 exceeds 09999 then a "one" appears on line 166 which is applied to the D input of D flip-flop 168. The clock pulse (CP) terminal of the D flipflop 168 is connected to line 160 such that when line 160 is enabled the state of D is transferred to Q with the complement thereof to $\overline{Q}$. Thus should the count exceed 09999 the Q output becomes "one" and $\overline{Q}$ "zero". On the other hand, if the count is less than 10000 then D will be "zero" and so also will Q,$\overline{Q}$ being "one".

The state of Q and $\overline{Q}$ determines from which four registers 162*a* to *e* the count is taken. When Q=1 and $\overline{Q}$=0, NAND gate 170 is enabled but NAND gate 172 is disabled. Thus when the count in registers 162 is clocked out the count will exit on line 174 while if Q=0 and $\overline{Q}$=1 the count will exit on line 176 to NAND gate 178.

With the decimal point as before occurring in register 162*b*, the count that finally emanates from gate 178 into line 180 after thirty-two clock pulses will be NNN.N if the count is greater than 09999 and hence exits on line 174, or NN.NN if the count is less than 10000 and hence exits on line 176. If the same meter is used as in the previous embodiment then, up to 99.99 liters of delivery, the display reads to an accuracy of 0.01 liters but beyond 99.99 liters the display reads to an accuracy of only 0.1 liters. However, the user is of course informed as to how many hundreds of liters are delivered which the previous embodiment could not do. However it should be appreciated that this arrangement could be installed in the system described with reference to FIG. 2 and similarly that of FIG. 2 could be employed here.

In the same way as the previous embodiment the meter sends pulses corresponding to known volumes of oil to reshaping circuit 182 where the pulses are applied to the first counter 164*a* on line 184.

Returning now to counter 112, a count of zero also resets latch 186 via line 120 such that a "one" is applied to line 188 (a zero subsists in line 124 at this stage) and thence to 4-stage binary programmable up/down counter 190 and sets it to count UP. The "one" in line 120 also resets counter 190 to 0000 via line 192. Via line 193, 7-stage binary counter 195 is reset to zero by the "one" in line 120.

Finally, via OR gate 194, D flip-flop 196 is reset to give a "one" on its $\overline{Q}$ output which, via line 198, enables NAND gate 200.

At the count of 2, a "one" is applied to line 122 which, via OR gate 202 and NAND gate 200 removes the enabling signal for counter 112 from line 205 and prevents its count from proceeding. At the same time the "one" now frozen on line 204 enables counter 114 which thus commences counting. As 2 is counted in counter 114 a pulse is applied to the clock-pulse input CP of D flip-flop 154 which thus applies to its $\overline{Q}$ output the complement of its D input subsisting at that time.

Since it can be assumed for the present that line 206 is in the "zero" state in that no station has been selected, it follows that the D input will be "one" if the line from NOR gate 228 is at "zero". Thus the output $\overline{Q}$ becomes "zero" on receipt of the clock pulse and so disables NAND gate 210 and applies a zero to the D input of D flip-flop 155.

On the count of 4 in counter 114 the pulse which emanates on line 134 is blocked by disabled NAND gate 210.

On the count of 6 a pulse is applied to the clock-pulse input of D flip-flop 155. Hence the "zero" persisting at its input is passed to its Q output while a "one" is applied to lines 226,230 from the $\overline{Q}$ output.

This "one" on line 226 firstly ensures that NOR gate 228 produces a "zero" and so ensures that NOR gate 207 produces a "one" while a "zero" persists on line 206. Indeed, while a "zero" persists in line 206 the states of flip-flops 154,155 remain as follows:

(a) D input 154: "one"
(b) $\overline{Q}$ output 154/D input 155: "zero"
(c) Q output 155: "zero"
(d) $\overline{Q}$ output 155: "one"

The "one" on line 230 would, but for the "zero" on line 208, enable gate 210.

The "zero" in line 212 from the Q output disables NAND gates 214,216 so that disabling "ones" on lines 218,220 to BCD-to-decimal decoders 222*a* and *b* persist. The sixteen outputs from these decoders drive solid state relays, not shown, which when appropriately energised open and close the solenoid valves in the oil supply lines to each station.

With the decoders 222*a* and *b* disabled all solenoid valves remain closed. The "zero" in line 212 also disables component 224 which is a 4-bit comparator and is further described below.

On the count of 8 a pulse is applied to line 138 and thence via NOR gate 249 to the input of counter 190 which is consequently raised by one to 0001.

Simultaneously, however, the same pulse is applied via line 211, OR gate 213, and NOT gate 215 to terminal E. Turning to FIG. 5, a pulse in line 156 clocks each D flip-flop 143. It also clocks the shift registers 300 referred to further below but because no information is contained in them this is not important.

However, assuming that the second station was selected on the previous cycle, a clock pulse to the D flip-flop of this station will result in Q becoming "zero" and the D input of the flip-flop 143 of the first station also becoming"zero". Nevertheless this will not yet affect the state of line 206.

If for the moment, however, it is assumed that no station selection has been effected at all then, after count 8 has finished, the count is immediately and continuously repeated in counter 114. The above described sequence of events is also repeated until eventually the count in counter 190 reaches 1111. This is long enough for a "one" to appear if at all in line 206 as a result of a selection of even the sixteenth station. When the count returns to 0000 however on the sixteenth count of 8 in counter 114 a "one" is applied to the carry out terminal C of counter 190 which serves as a clock pulse for D flip-flop 196. A "one" is permanently applied to its D input so that its $\overline{Q}$ output in line 198 changes to "zero". This then disables NAND gate 200 which consequently enables counter 112 to continue counting.

Once count 2 of counter 112 has completed, the enabling state on line 204 ceases and counter 114 stops counting.

At the count of 4 in counter 112 a "one" is applied to line 124 which serves to reset latch 186 (a "zero" subsisting at this time on line 120) so that a "zero" appears on line 188. This "zero" is applied to 4-stage binary programmable up/down counter 190 and sets it to count DOWN.

Furthermore, the "one" in line 124 presets counter 190 via line 197 to read 1111. Also via OR gate 194 D flip-flop 196 is reset to apply a "one" to the $\overline{Q}$ output which thus re-enables NAND gate 200.

On the count of 6 in counter 112 a "one" is applied to line 126 which via OR gate 202 and NAND gate 200 once again removes the enabling signal for counter 112 from line 205 and prevents the count from proceeding further.

The "one" is also applied on line 232 however to AND gates 234 and 236. At present there is no signal on line 238 to gate 234 in which case no signal emanates on line 240 from gate 234. However, by enabling gate 236 clock pulses from clock pulse generator 110 on line 111 can pass through gate 236 to line 242. These clock pulses are fed via gates 213, 215 to terminal E which, with no remote station selected clocks 16×32 "zero" pulses (as explained further below) to remote registers 300*a* to 300*d* of each remote display 271.

The train of pulses are also applied via line 244 to 7-stage binary counter 195 which is arranged to give a pulse on line 246 every time it receives thirty-two pulses from line 244. The pulses in line 246 are applied to NOR gate 249 and thence to the input of counter 190 which presently is counting down from 1111.

Eventually after sixteen pulses from counter 195 (512 pulses in line 244), counter 190 is reduced to 0000 and once more this causes a "one" to be applied to the clock pulse input of D flip-flop 196. This has the same effect as mentioned before in that counter 112 is re-enabled again via line 198, gate 200 and line 205 and the count continues. Moreover gates 234 and 236 are disabled.

On the count of 8 a "one" is applied to line 128 as explained initially and subsequently the count in counter 112 begins again and the whole cycle repeats.

If the second station has been selected however as initially postulated, then the pulse to terminal E on the second count of 8 in counter 114 clocks D flip-flop 143 in the first station so that line 206 changes to "one" and the state of the D input of D flip-flop 154 changes from "one" to "zero".

After this second count of 8 in counter 114 the count is once again restarted in counter 114 and at the count of 2 therein a pulse is applied to the clock pulse input of D flip-flop 154. Thus the state of $\overline{Q}$ in this flip-flop is changed from "zero" to "one".

This "one" is applied on line 208 to NAND gate 210 which is enabled thereby since the "one" in line 230 has not changed. The "one" is also applied to the D input of D flip-flop 155.

On the count of four a pulse emanates in line 134. Since both lines 208 and 230 carry "ones" at this stage the pulse passes through gate 210 as a "zero" and is inverted to a "one" by NOT gate 248. The resulting "one" firstly resets to zero the counters 164*a* to *e* by way of line 250 and secondly, via line 252, loads the outputs of Quad-D Register 254 with the inputs presently applied by counter 190, that is 0010, representing two counts of 8 in counter 114.

On the count of 6 in counter 114 a pulse is applied via line 136 to the clock pulse input of D flip-flop 155 so that the "one" presently applied to the D input also appears at its Q output while the $\overline{Q}$ output changes to "zero".

A "one" on line 212 enables gates 214,216. Because the number 0010 presently subsists in counter 190, and hence at the outputs of register 254, a "zero" is applied to line 217 by virtue of the fact that the first digit of 0010 is a zero. Because NOT gate 219 precedes NAND gate 216 this "zero" is converted to "one" and hence the inhibiting "one" which previously subsisted in both lines 218 and 220 is removed from line 220. The three remaining inputs to BCD-to-Decimal decoder **222*b* is sufficient to identify one of eight lines leading to solid state relays (not shown) operating the solenoid valves of each station. Thus 010 in this decoder activates the second output which leads to the second station. If the count in counter 190 had been 1010 however then only gate 214 would have been enabled. Although 010 would still activate the second output of decoder 222*a***, this output is connected to the tenth station.

The "one" on line 212 also activates via line 256 4-bit comparator 224 which compares the present state of counter 190 with the state held in register 254. At the present moment both have 0010 on their outputs and so an "equals" "one" is applied by comparator 224 to line 258.

On the one hand this "one" on line 258 maintains a "zero" output on NOR gate 228 even though the $\overline{Q}$ output from flip-flop 155 on line 226 has been reduced to zero.

On the other hand, this "one" from the "equals" output of comparator 224 is also applied to and enables AND gates 234 and 235 via line 238.

As already mentioned the $\overline{Q}$ output of D flip-flop 155 changes to zero as the Q output changes to "one". Thus gate 210 is now disabled by line 230.

On the third count of 8 counter 190 is clocked to read 0011. At this point the inputs to comparator 224 are no longer equal and so a "zero" is applied to line 258 which thereby disables AND gates 234,235. More importantly, however, two "zeros" are now applied to NOR gate 228 and so a "one" is applied to NOR gate 207. Thus the output of NOR gate 207 is held at "zero" even though, on the count of 8, line 206 may be changed to "zero" as the state of D flip-flop 143 in the first station is clocked into it by the pulse from terminal E.

On the count of 2 on the next cycle of counts in counter 114 the "zero" continuing to appear at the D input of D flip-flop 154 is transferred by the pulse arriving on line 132 as a "one" on the $\overline{Q}$ line. However, because the $\overline{Q}$ output from D flip-flop 155 is "zero" gate 210 does not allow the pulse on line 134, on the count of 4 in counter 114, from passing and so the output from register 254 remains at 0010. Also the counters 164 are not reset.

On the count of 6, the "one" from $\overline{Q}$, D flip-flop 154 maintains a "one" on the Q output and a "zero" on the $\overline{Q}$ output of D flip-flop 155 when the pulse on line 136 is received. This therefore maintains the selection of a solid state relay and in fact the same one as previously selected because register 254 has not changed.

On the fourth count of 8, counter 190 is clocked to 0100 but nothing else changes. Eventually 0000 is clocked into counter 190 in which event the carry out signal to D flip-flop 196 restarts counter 112 which then proceeds to count of 4.

On the count of 4, latch 186 is set to load counter 190 in the COUNT DOWN mode, counter 190 is preset to 1111 and D flip-flop 196 is reset to enable gate 200.

On the count of 6 in counter 112 the count is stopped again and gates 234 and 236 are enabled. The clock pulses in line 111 therefore clock counter 195 via lines 242,244 which progressively reduces the count in counter 190 in multiples of 32 clock pulses. After 14 multiples of 32 the count in counter 190 is reduced to 0010 whereupon comparator 224 applies an equals "one" to line 258 over the next 32 pulses clocked into counter 195. Line 258 enables gates 234 and 235. Since gate 234 is enabled by both its inputs a "one" is applied to its output on line 240 thereby enabling and gate 241. Since gate 235 is now enabled the clock pulses emanating from gate 236 on line 237 are allowed to pass into line 163 and are applied to registers **162*a*** to *e*. The count stored in these registers is therefore clocked out, via gate 170 or 172, whichever is enabled by D flip-flop 168, into line 180. Since gate 241 is enabled as mentioned above the information can pass to line F where it is subsequently clocked into registers **300*a*** to *d* at the first station 271 by the same clock pulses coming from gate 236, via gates 213 and 215, line 156 and terminal E.

After 32 clock pulses another pulse emanates in line 246 from counter 195 and this clocks counter 190 down to 0001 at which stage the "equals" output on line 258 from comparator 224 ceases. This therefore disables gates 234 and 235 preventing further information from being clocked out of registers **162*a*** to *d*. Nevertheless clock pulses still pass through gate 236 and another thirty-two clock the information in registers 300 at the first station, replacing that with all zeros, into the registers 300 at the second station. These thirty-two pulses also add up to clock the sixteenth pulse from counter 195 into line 246 which thereby reduces the total count in counter 190 to 0000.

At this point the carry out once again changes the state of $\overline{Q}$ output of D flip-flop 196 and so counter 112 is once again restarted where upon the next count is count 8 and this applies a "one" to line 128. This, via gates 140,142 and terminal D loads the displays 302 in all the stations with the information contained in their respective shift registers 300. In the case of the second station this information is that which not long before had been stored in registers 162. If this was the first complete cycle after the second station had been selected, it is likely that this information is also all zeros but if it has been selected for a number of cycles that information will change as oil is dispensed and the meter clocks counters 164.

Figure 6:
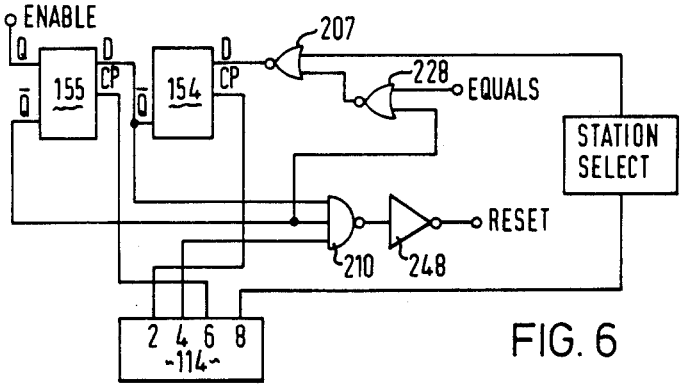

The selection procedure is summarised with reference to FIG. 6 which shows the main elements of the circuit which is run by counter 114. The count of 8 prompts a station selection to appear at the input to NOR gate 207.

While no selection is made this is "zero", and normally a "zero" also appears on the output of NOR gate 228 because either the EQUALS input is "one" or the $\overline{Q}$ output from D flip-flop 155 is "one". Thus the output of NOR gate 207 is normally "one". As the counter 114 clocks several times equilibrium is established as mentioned above wherein the various outputs are as follows:

(a) D input 154: one
(b) $\overline{Q}$ output 154/D input 155: zero
(c) Q output 155/ENABLE: zero
(d) $\overline{Q}$ output 155: one (e) output NOR gate 228: zero (f) output NAND gate/NOT gate 210/248: zero When a selection is *first* made however a "one" is suddenly applied to NOR gate 207 whose output changes to "zero". On the next count of 2, $\overline{Q}$ output from flip-flop 154 changes to "one" and so NAND gate 210 is enabled. Thus on count 4 all inputs of gate 210 are "one" and so the RESET feature is activated. This resets the counters 164 (FIG. 4) to zero and also loads the memory 254 (FIG. 4) so that the circuit can identify which station is selected. On count 6 a "one" is caused to be applied to the Q output 155 which enables the appropriate station and a "zero" is present at the $\overline{Q}$ output 155. This "zero" is applied to NAND gate 210 and NOR gate 228.

On the next count of 8 the EQUALS input becomes "zero" so that two "zeros" are applied to NOR gate 228 which thus applies a "one" to NOR gate 207. Thus, regardless thereafter of the state of the STATION SELECT input, (i.e. whether the next station has also been selected or not) the NOR gate 207 will continue to input a "zero" to D input 154. Thus another equilibrium is established as follows:

(a) D input 154: zero (b) $\overline{Q}$ output 154/D input 155: one (c) Q output 155/ENABLE: one (d) $\overline{Q}$ output 155: zero (e) output NOR gate 228: one (f) output NAND gate/NOT gate 210/248: zero This equilibrium will remain for fifteen more runs through counter 114 until the SELECT input refers to that of the station initially selected. At this time the EQUALS input changes to "one" so that the output of gate 228 changes to zero. As long as this station remains selected however a "one" will still be applied to gate 207 and so the states or flip-flops 154,155 will not change. Indeed it is only when the station is unselected such that a "zero" is applied to the SELECT line and when the output of gate 228 changes to "zero" that the D input 154 changes to "one". Then a "zero" is subsequently applied to the ENABLE line and the selection is terminated.

While one station is selected it should thus be appreciated that the state of selection of the other stations is irrelevant. Once however a station is unselected and a "zero" is returned to the output of NOR gate 228 then on subsequent runs through counter 114, if a new station has indeed been selected then that selection will bring about the enabling of that particular station.

Each run through counter 114 is in effect an inspection of the state of selection of each station in turn. While one station, say number 5 out from the control box, is enabled it remains that way until it is unselected. If in the meantime station 2, followed by station 7, is also selected, these stations will not be enabled until station 5 is unselected. However, once station 5 is unselected then after two more runs through counter 114 the selection of station 7 will be noted and it will be enabled. This occurs before enabling of station 2 which has not yet been inspected even though station 2 was in fact selected first. Only when station 7 is unselected and after $(16-7)+2$ more runs through counter 114 will station 2 then be enabled.

As mentioned above when a station is selected this fact is indicated to the operator by light emitting diode 145.

If a station has not been selected, or if a station is selected but has not yet been enabled or even if it has been enabled but no oil has yet been dispensed the figures stored in registers 300 will be all zeros. In order to inform the user that not only is his station selected but also that it is enabled and that it can now dispense oil it is desirable that the displays 302 in a given station are only energised to display whatever is in their respective store registers 300 when that station is both selected and enabled.

This can only be effected in practise by using the decimal point facility in the number stored because the decimal point will always be at "one" when the stored number in a set of registers 300 at a station is derived from the counters 164, i.e. when that station is enabled.

Thus lines 304,306 are applied to NOR gate 308 from the decimal point terminals of registers 300*a* and 300*b* of each station. If either is at "one" then the output of NOR gate 308 will be "zero" whereas if both are at zero a "one" will be applied to each display 302 to disable it, that is to blank it out. Such an arrangement can also be used to blank out unused displays 271, in FIG. 3 although this is not illustrated in this embodiment.

To ensure that all segments in all the displays are functioning, switch 157 (FIG. 4) when actuated applies a constant stream of "ones" to line 156 so that 8's are displayed on all displays.

In both the FIG. 1 and FIG. 2 embodiments, the meter generates pulses corresponding to known volumes of liquid, typically 0.01 liter quantities. Without the necessity of providing an extra display segment or indeed employing the extra counter 164 in the FIG. 4 embodiment, it is still possible to improve the acurracy of the system by the following means. Each pulse from the meter is in the form of a "one" or a "zero" appearing in line 45 (FIG. 2) or line 184 (FIG. 4). A simple circuit can be interposed in those lines to generate a pulse on each occasion a "one" changes to a "zero" and vica versa. Thus two pulses are generated for each pulse from the meter. If these pulses are fed directly to one register 40 or 162 in which the decimal point position is not normally used then that decimal point in the appropriate display will flash on receipt of each pulse. Thus an accuracy of 0.005 liters is established. Of course it is also simple to arrange not for a dedimal point to flash, but instead for some other available character in the display to flash, for example a minute (') symbol. Before entering the counters 42,164 the two pulses can once again be consolidated into single pulses for counting as described above.

Finally, although the above-described systems are arranged as discrete logic circuits it is feasible that certain functions could be performed by an appropriately programmed microprocessor or the like.

We claim:

1. A liquid dispensing system comprising:

(a) a source of liquid;

(b) pump means;

(c) a single meter to measure the quantity of liquid pumped by the pump means;

(d) a plurality of remote dispensing stations;

(e) means to direct the liquid to each dispensing station;

(f) a display associated with and adjacent each dispensing station; and (g) a control station including control means;

(i) to select and enable any one dispensing station whereby liquid is dispensible at that station;

(ii) and while at the same time, to disable all the other dispensing stations whereby liquid is not dispensible at any of those stations;

(iii) to monitor the single meter;

(iv) to effect a reading on the display associated with said one station, said reading corresponding to the volume of liquid passing through the single meter and being dispensed at said one dispensing station; and, (v) while at the same time, to effect a zero or null reading on the displays associated with all said other dispensing stations.

2. A Liquid dispensing system as claimed in claim 1 in which pulses representing precise known volumes of Liquid passing through the meter are generated by the meter and counted in one or more serially connected meter counters in the electronic control means.

3. A liquid dispensing system as claimed in claim 2 wherein, on receipt of a signal from an enabling device the count stored in the or each meter counter is loaded into serial output meter shift registers in the form of a specific number of bits of information.

4. A liquid dispensing system as claimed in claim 3 in which the displays of each station are serially connected and comprise serial input/serial output display shift registers of the same bit capacity as and in the same quantity as the meter shift registers.

5. A liquid dispensing system as claimed in claim 4 in which clock pulses clock the display shift registers such that the information contained in them is shifted into the next display after said specific number of pulses, in which after some multiple of said specific number, said multiple corresponding to the station selected, said clock pulses are also applied to the meter shift registers such that, over the next specific number of pulses, the information in those registers is clocked into the first of the display shift registers and in which after further multiples of said specific number of clock pulses the enabling device provides a signal loading each display with the number stored in its respective shift registers, such that the information previously stored in the meter shift registers is displayed at the station selected.

6. A liquid dispensing system as claimed in claim 5 in which an extra serially connected meter counter and associated meter shift register is provided and in which the count clocked out of the meter shift registers excludes the count in the meter shift registers at the most significant end if that shift register stores zeros but excludes the count in the shift register at the least significant end if the shift register at the most significant end contains anything higher than zeros, means being provided to indicate from which shift registers the count is taken.

7. A liquid dispensing system as claimed in claim 6 in which, when the most significant counter contains a number higher than zero, a first gate is enabled and a second gate disabled but when the most significant counter contains only, zeros said first gate is disabled and second gate enabled, said first gate being connected to the meter shift registers upstream of the least significant meter shift register thereby excluding it from the count clocked out of the registers through said first gate when it is enabled and by said same specific number of clock pulses, and said second gate being connected to the meter shift registers downstream of the least significant meter shift register therby including it in the count clocked out of the registers via said second gate when it is enabled but not including the count in the most significant register.

8. A liquid dispensing system as claimed in any of claims 3, 4, or 5 in which there are four meter shift registers each comprising an eight-stage parallel input/-serial output shift register, in which there are four display registers in each display each comprising an eight-stage serial input/parallel output shift register and in which said specific number is thirty-two.

9. A liquid dispensing system as claimed in claim 8 wherein each meter shift register stores a decimal digit in the form of a 7-segment display code and wherein the eighth available bit in the registers drives a decimal point if required.

10. A liquid dispensing system as claimed in either of claims 6 or 7 wherein there are five meter shift registers each comprising an eight-stage parallel input/serial output shift register, in which there are four display registers in each display each comprising an eight-stage serial input/parallel output shift register and in which said specific number is thirty-two.

11. A liquid dispensing system as claimed in claim 10 wherein each meter shift register stores a decimal digit in the form of a 7-segment display code and wherein the eighth available bit in the registers drives a decimal point if required.

12. A liquid dispensing system as claimed in claim 3 in which said enabling device comprises an enabling counter supplied with clock pulses which progressively clock the counter to provide enabling signals on different lines after different counts.

13. A liquid dispensing system as claimed in claim 6 in which after each multiple of said specific number of clock pulses, a signal is applied to a DOWN counter preset to the total number of stations in use and whose subsisting count is compared in a comparator with an individual number corresponding to the station selected, the comparator providing a signal when said count and number are the same to enable said clock pulses to be applied to the meter shift registers.

14. A Liquid dispensing system as claimed in claim 1 in which said electronic control means includes means to disable and cancel any existing selection of a station when another station is selected.

15. A Liquid dispensing system as claimed in claim 1 in which said electronic control means includes means enabling a number of stations to be selected by only one to be enabled when a previously enabled station is unselected.

16. A liquid dispensing system as claimed in either of claims 3 15 in which said enabling device comprises first and second interactive enabling counters each supplied with clock pulses hich progressively clock the enabling counters to provide enabling signals on different lines after different counts.

17. A liquid dispensing system as claimed in claim 16 comprising two phases, the first phase being initiated by the first enabling counter but controlled by counts in the second enabling counter and the second phase being initiated by the end of the first phase and controlled by counts in the first enabling counter, said first phase being concerned with the selection and enabling of a station and said second phase being concerned with the display of information from the meter shift registers at the appropriate station.

18. A liquid dispensing system as claimed in claim 17 further comprising a selection circuit which on receipt of a signal from a specific station when that station has been selected, ignores the signal if another station has already been selected and enabled or enables that station if no other station has been detected as being selected.

19. A liquid dispensing system as claimed in claim 18 wherein the selection circuit resets the meter counters to zero and allows a number to be loaded into a store corresponding to the number of the station selected when and only when that station is first selected and immediately prior to it being enabled.

20. A liquid dispensing system as claimed in claim 18 in which said selection circuit comprises two D flip-flops, the $\overline{Q}$ output of the first being connected to the D input of the second, and two gates the output of the first gate being connected to the D input of the first D flip-flop and the output of second gate being connected to the input of the first gate the other input of the first gate being connected to a STATION SELECT line and the inputs of the second gate being connected one to the $\overline{Q}$ output of the second D flip-flop and the other to an EQUALS line, the EQUALS line being active only when a station has previously been selected and when the signal then subsisting on the STATION SELECT line is that applicable to the station previously selected, the Q output from the second D flip-flop providing an ENABLE line to enable the selected station and the CLOCK PULSE inputs of the two D flip-flops being connected to different outputs of said second enabling counter.

21. A liquid dispensing system as claimed in claim 20 in which the $\overline{Q}$ outputs of both D flip-flops control a gate determining whether the meter counters are reset to zero and whether the store is loaded with the number of the station selected.

22. A liquid dispensing system as claimed in claim 21 in which said gates are NOR gates and a logical "one" is applied to the STATION SELECT line when a station is selected and to the EQUALS line when it is active and also to the ENABLE line when a selected station is to be enabled.

23. A liquid dispensing system as claimed in claim 19 in which during the first phase clock pulses firstly progressively shift the state of selection of each station into the previous adjacent station or into the selection circuit and secondly increase the count from zero held in a selection counter until a selection is detected whereupon, if no selection already exists, the meter counters are reset to zero and the count in the selection counter is loaded in the store, the selection circuit subsequently enabling the station corresponding to the number loaded in the store.

24. A liquid dispensing system as claimed in claim 23 in which, during the second phase the selection counter is set to count DOWN from a preset count corresponding to the number of stations in use, in which after each multiple of said specific number of clock pulses the count in the selection counter is reduced by one until it is the same as that in the store whereupon a comparator, to which the count from the selection counter and the count in the store are applied, enables the next set of said specific number of clock pulses also to be applied to the meter shift registers to clock the count held in them into the display registers of the first station and in which after further multiples of said specific number of clock pulses the count in the selection counter is reduced to zero whereupon said first enabling counter loads the displays at each station with the information stored in their respective display registers.

25. A liquid dispensing system as claimed in claim 24 in which during the first phase the comparator is activated only when a station is enabled and activates said EQUALS line only when the count in the selection counter and store are the same.

26. A liquid dispensing system as claimed in claim 19 in which said selection circuit comprises two D flip-flops, the $\overline{Q}$ output of the first being connected to the D input of the second, and two gates the output of the first gate being connected to the D input of the first D flip-flop and the output of second gate being connected to the input of the first gate the other input of the first gate being connected to a STATION SELECT line and the inputs of the second gate being connected one to the $\overline{Q}$ output of the second D flip-flop and the other to an EQUALS line, the EQUALS line being active only when a station has previously been selected and when the signal then subsisting on the STATION SELECT line is that applicable to the station previously selected, the Q output from the second D flip-flop providing an ENABLE line to enable the selected station and the CLOCK PULSE inputs of the two D flip-flops being connected to different outputs of said second enabling counter.

27. A liquid dispensing system as claimed in claim 26 in which the $\overline{Q}$ outputs of both D flip-flops control a gate determining whether the meter counters are reset to zero and whether the store is loaded with the number of the station selected.

28. A liquid dispensing system as claimed in claim 27 in which said gates are NOR gates and a logical "one" is applied to the STATION SELECT line when a station is selected and to the EQUALS line when it is active and also to the ENABLE line when a selected station is to be enabled.

29. A liquid dispensing system as claimed in claim 20 in which said gates are NOR gates and a logical "one" is applied to the STATION SELECT line when a station is selected and to the EQUALS line when it is active and also to the ENABLE line when a selected station is to be enabled.

30. A liquid dispensing system as claimed in claim 20 in which during the first phase a comparator is activated only when a station is enabled and activates said EQUALS line only when the count in the selection counter and store are the same.

* * * * *